US006711843B2

(12) United States Patent
Klebes

(10) Patent No.: US 6,711,843 B2
(45) **Date of Patent: *Mar. 30, 2004**

(54) FIREARM INCLUDING BIOMETRIC SKIN SENSOR

(75) Inventor: John F. Klebes, Feeding Hills, MA (US)

(73) Assignee: Smith & Wesson Corp., Springfield, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 58 days.

(21) Appl. No.: 10/027,133

(22) Filed: Dec. 20, 2001

(65) Prior Publication Data

US 2003/0115786 A1 Jun. 26, 2003

(51) Int. Cl.[7] ..... F41A 17/00
(52) U.S. Cl. ..... 42/70.11; 42/84
(58) Field of Search ..... 42/70.11, 84, 66

(56) References Cited

U.S. PATENT DOCUMENTS 4,467,545 A * 8/1984 Shaw, Jr. ..... 42/70.01
4,768,021 A 8/1988 Ferraro
4,970,819 A * 11/1990 Mayhak ..... 72/70.01
5,459,957 A 10/1995 Winer
5,579,909 A 12/1996 Deal
5,603,179 A 2/1997 Adams
5,701,770 A 12/1997 Cook et al.
5,812,252 A 9/1998 Bowker et al.
5,915,936 A * 6/1999 Brentzel ..... 42/70.11
5,937,557 A * 8/1999 Bowker et al. ..... 102/472
5,982,914 A * 11/1999 Lee et al. ..... 382/124
6,061,463 A * 5/2000 Metz et al. ..... 382/124
6,098,330 A * 8/2000 Schmitt et al. ..... 382/145
6,185,852 B1 * 2/2001 Whalen et al. ..... 42/70.11
6,343,140 B1 * 1/2002 Brooks ..... 348/156
6,354,033 B1 * 3/2002 Findley ..... 72/70.01
6,421,943 B1 * 7/2002 Caulfield et al. ..... 42/70.11

* cited by examiner

*Primary Examiner*—Michael J. Carone
*Assistant Examiner*—M. Thomson
(74) *Attorney, Agent, or Firm*—McCormick, Paulding & Huber LLP

(57) ABSTRACT

An electronic firearm comprises a barrel assembly and a handle assembly coupled to the barrel assembly. The handle assembly includes a grip portion defining a cavity and at least one opening disposed generally at a rear side of the grip portion, and a biometric sensing device disposed within the cavity and aligned with the at least one opening of the grip portion for scanning the skin of a portion of the user's hand opposing the opening to determine whether the user is authorized to discharge the electronic firearm.

9 Claims, 2 Drawing Sheets

FIREARM INCLUDING BIOMETRIC SKIN SENSOR

CROSS REFERENCE TO RELATED APPLICATION

Some related material is disclosed and claimed in U.S. patent application Ser. No. 09/625,688, filed Jul. 26, 2000, entitled: "AUTHORIZATION MODULE FOR ACTIVATING A FIREARM AND METHOD OF USING SAME, the disclosure of which is herein incorporated by reference.

FIELD OF THE INVENTION

This invention relates generally to a firearm, and more particularly to an electronic firearm including a biometric skin sensor.

BACKGROUND OF THE INVENTION

Manufacturers have recently incorporated electronic circuitry in firearms to improve their performance and reliability. One area of particular interest in firearm improvement using electronics is to prevent the use of firearms by unauthorized persons such as children or other non-owners.

A method of preventing unauthorized use is the incorporation of a fingerprint identification device with the firearm. Fingerprint identification systems generally are known in the electronics industries. U.S. patent application Ser. No. 09/625,688, filed Jul. 26, 2000 and owned by assignee of the present invention is directed to an authorization module including a fingerprint detector incorporated into the firearm. The fingerprint detector requires a user to momentarily place a finger tip over the detector for scanning and thereby determining that whether the user is authorized to use the associated firearm. In other words, these fingerprint detectors typically require the user to perform an additional step of placing a finger tip over the fingerprint detector before the user can grip the firearm and discharge it. Moreover, optoelectronic finger reading systems typically require pressing a finger against the reading apparatus. It is common for a user to be required to repeatedly withdraw the finger and put it back several times until the system comparing a prerecorded image of the user's fingerprint with the swiped fingerprint to make a valid comparison. The additional time spent in performing the identification step before gripping and using the firearm can place the user in jeopardy if an emergency requires quick discharge of the firearm.

Further, frequent mistakes exist in conventional fingerprint recognition methods which are due to an inability to keep the finger at the same pressure against an optoelectronic reader during prerecording and actual recognition sessions. The deformation of a fingerprint in both cases is generally not repeatable even with the use of very sensitive recognition algorithms. In sum, variation of pressure causes unrepeatable deformation of a fingerprint and in turn difficulties in identification of the same finger.

It is a general object of the present invention to provide an electronic firearm that avoids the above-mentioned drawbacks.

SUMMARY OF THE INVENTION

In a first aspect of the present invention, an electronic firearm comprises a barrel assembly and a handle assembly coupled to the barrel assembly. The handle assembly includes a grip portion defining a cavity and at least one opening disposed generally at a rear side of the grip portion, and a biometric sensing device disposed within the cavity and aligned with the at least one opening of the grip portion for scanning the skin of a portion of the user's hand opposing the opening to determine whether the user is authorized to discharge the electronic firearm.

In a second aspect of the present invention, an electronic firearm comprises a barrel assembly and a handle assembly coupled to the barrel assembly. The handle assembly includes a grip portion defining a cavity and at least one opening disposed generally at a rear side of the grip portion at a lower location along the grip portion to oppose the palm of the user's hand, and a biometric sensing device disposed within the cavity and aligned with the at least one opening of the grip portion for scanning the palm of the user's hand opposing the opening to determine whether the user is authorized to discharge the electronic firearm.

In a third aspect of the present invention, an electronic firearm comprises a barrel assembly and a handle assembly coupled to the barrel assembly. The handle assembly includes a grip portion defining a cavity and at least one opening disposed generally at a rear side of the grip portion at an upper location along the grip portion to oppose the web area of the user's hand, and a biometric sensing device disposed within the cavity and aligned with the at least one opening of the grip portion for scanning the web area of the user's hand opposing the opening to determine whether the user is authorized to discharge the electronic firearm.

An advantage of the present invention is that the electronic firearm performs a biometric scan while the user's hand is in a natural gripping position for discharging the firearm.

A second advantage of the present invention is that the biometric sensing device is incorporated within the firearm so as to provide a compact firearm.

A third advantage of the present invention is that the additional step of swiping a fingertip across a biometric sensing device is eliminated.

A fourth advantage of the present invention is that the biometric sensing device can be incorporated at various locations along the grip portion of the firearm.

These and other advantages of the present invention will become more apparent in the light of the following detailed description and accompanying drawings.

DETAILED DESCRIPTION OF THE PREFERRED EMBODIMENT

Figure 1:
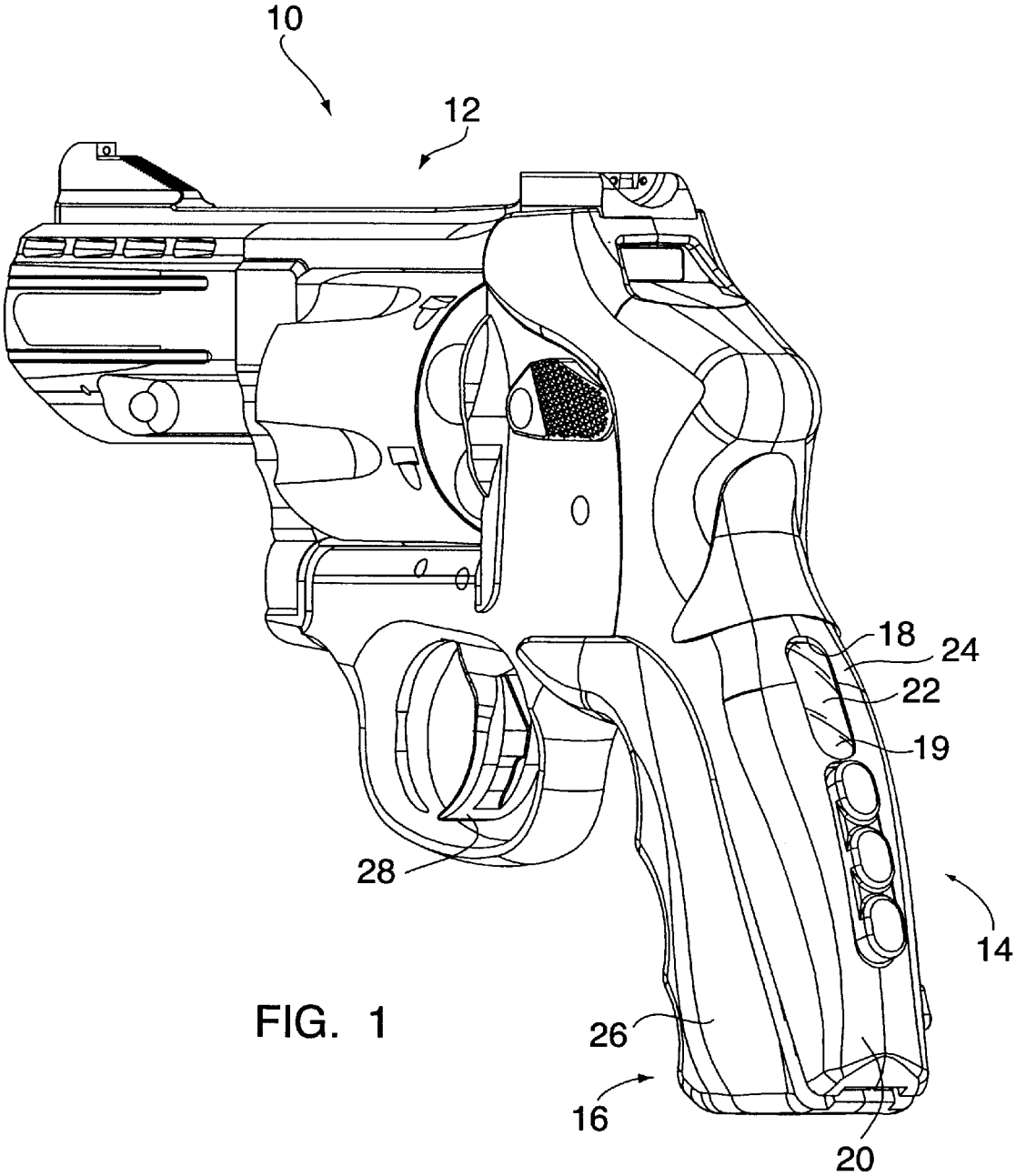
FIG. 1 is a perspective view of a firearm incorporating a biometric sensing device to scan the palm portion of a user's hand, in accordance with the present invention.

Referring to FIG. 1, an electronic firearm embodying the present invention is generally designated by the reference number 10. The firearm 10, such as a revolver shown in FIG. 1, includes a barrel assembly 12, and a handle assembly 14 coupled to the barrel assembly. The handle assembly 14 includes a grip portion 16 defining a cavity for accommodating electronic control circuitry for operating the firearm 10, and at least one opening 18 disposed generally at a rear side 20 of the grip portion 16. A biometric sensing device 22 as part of the electronic control circuitry is disposed within the cavity and is aligned with the at least one opening 18 of the grip portion 16 for scanning the skin of a portion of the user's hand opposing the at least one opening to determine whether the user is authorized to discharge the electronic firearm 10, and upon verification of authorization to enable the firearm to be discharged. Preferably the at least one opening 18 for the sensing device is defined by the rear side 20 of the grip portion 16 at a location to oppose the user's hand such as the web area between the thumb and index finger, or the palm. As shown in FIG. 1, preferably the opening 18 defined by the rear side 20 of the grip portion 16 is disposed generally at an upper location 24 along the grip portion so as to oppose the web of the user's hand. Alternatively as shown in FIG. 2, a firearm 100, such as a pistol, includes a handle assembly 102 with a grip portion 104 defining two openings 106 generally at a lower location 108 along the grip portion so as to oppose the palm of the user's hand.

Figure 2:
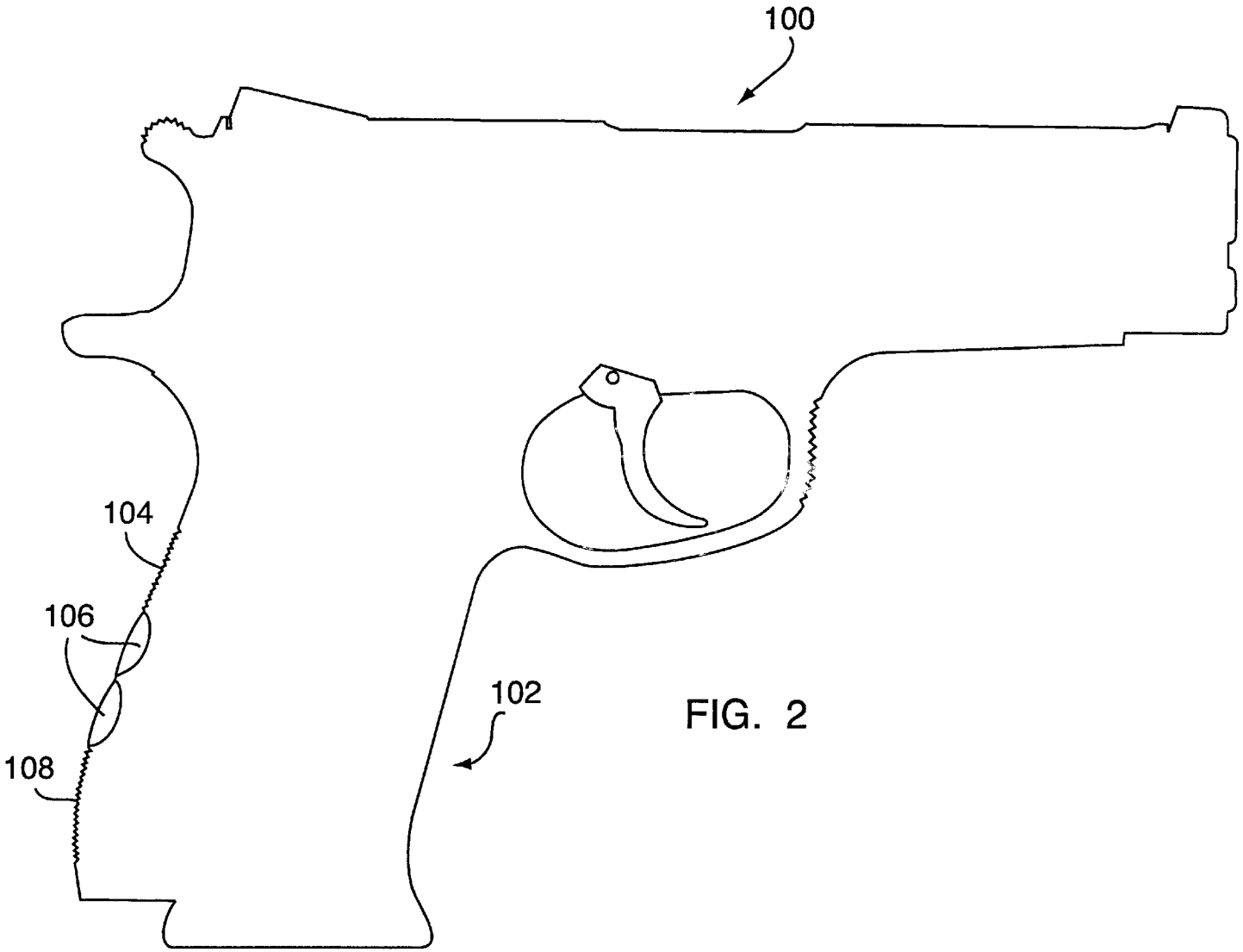
FIG. 2 is a schematic, side elevational view of a firearm incorporating a biometric sensing device to scan the web portion of a user's hand, in accordance with the present invention.

The opening 18 shown in FIG. 1 and the openings 106 shown in FIG. 2 preferably have a transparent cover, such as cover 19 shown in FIG. 1, so as to form a window. One implementation of the openings is to employ an acrylic polymer or other lens-like material that allows light transfer at predetermined frequencies to be coupled through the grip portion from the skin to the biometric sensing device under the window. A second implementation is that the skin may come into direct contact with the biometric sensing device by physical contact through the opening. A third implementation is non-contact sensing of the skin sample by a biometric sensing device recessed in the opening and located below the grip surface.

The transparent cover or lens for the biometric sensing device openings is preferably flush with the surface contour of the grip portion. The upper location of the grip portion positions the web of the hand between the thumb and index finger in a firm, uniform and repeatable way. The rounding of the grip portion toward the left and right leaves a relatively flat portion on the direct back of the grip portion that is generally uniform in the way it puts pressure on the skin independently of the gripping force. Most of the gripping force is applied to the arcs of the radius of the grip portion instead of the flatter tangent between the two corners so as to result in a repeatable and consistent deformation of the skin when gripping. The lower location of the grip portion does not appear to be as uniform and repeatable in the way the hand applies pressure and the way the hand is positioned around the grip portion, and therefore the lower location of the grip portion is not as good a location as is the upper location to position the biometric sensing device. However, as shown in FIG. 2, multiple openings 106 for skin sensing may improve accuracy.

It has been discovered that biometric technology can be used with firearms not only to identify authorized users from their fingerprints, but also from other characteristics of the human skin that are generally unique to the individual. Such unique characteristics of skin tissue are present in all skin areas and not just in the fingertips. For example and as stated above, a biometric information can be generated from scanning the skin tissue of the web area of the hand between the thumb and index finger, or scanning the palm area. Scanning these areas of the hand lends itself well to a firearm or any gripped device because this area of skin tissue comes into contact with the back surface of the grip portion of the firearm. Conventional biometric technologies such as, for example, optical, thermal, E-field, and capacitive sensing fingerprint sensors may be used to examines skin pore data generally unique to the individual instead of fingerprint data. With such an approach, the sensor area can be smaller, and the cost of such an approach less expensive relative to fingerprint analysis.

Moreover, it has been discovered that the sophistication of the firearm electronics for prerecording and comparing the skin tissue of the web or palm area of an authorized user to that of the actual user can be significantly less and more cost effective than corresponding circuitry for fingerprint identification methods. The sophistication of the electronic circuitry for analyzing fingerprints is due in part to the complex nature of fingerprints, the distortion of fingerprints under various contact pressures, fading fingerprint intensity as the user ages, a large area required to obtain sufficient fingerprint data for recognition, and the inconsistencies in the user placing this large area of skin uniformly and repeatably in front of the scanner.

It has also been discovered that the web or palm of the user's hand exerts a generally uniform contact pressure on the grip portion of a firearm relative to other portions of the hand, such as the fingers. Moreover, the contact pressure exerted on the grip portion by the palm or web of the hand has been found to be generally independent of the gripping force. Scanning a portion of the user's hand that exerts a generally uniform contact pressure on the grip portion results in a more accurate scan of the skin properties of the user's hand relative to other areas of the hand.

In operation, by way of example with respect to FIG. 1, the user grips the firearm 10 by placing the hand in a natural gripping position for discharging the firearm. More specifically, the user positions a hand about the grip portion 16 of the handle assembly 14 such that the palm and web areas of the hand generally oppose the rear side 20 of the of the grip portion 16, and the fingers curl around a front side 26 of the grip portion adjacent to a trigger 28 of the firearm 10. As shown in FIG. 1, the opening 18 defined by the grip portion 16 permits the biometric sensing device 22 to scan the palm of the user's hand for determining whether the user is authorized to discharge the firearm 10, and upon authorization enabling the firearm to discharge following a pull of the trigger 28. Because the skin of the user's hand is scanned by the biometric device 22 while the hand is placed in the natural gripping position on the grip portion 16, an otherwise additional step of, for example, swiping a fingertip across a fingerprint identification device is eliminated so as to speed up the process for authorizing and electronically enabling the use of the firearm.

Although the invention has been shown and described in preferred embodiments, it should be understood that numerous modifications can be made without departing from the spirit and scope of the present invention. Accordingly, the present invention has been shown and described by way of illustration rather than limitation.

What is claimed is:

1. An electronic firearm comprising:

a barrel assembly; and a handle assembly coupled to the barrel assembly, the handle assembly including a grip portion defining a cavity and at least one opening disposed generally at a rear side of the grip portion, and a biometric sensing device disposed within the cavity and aligned with the at least one opening of the grip portion for scanning the skin of a portion of the user's hand opposing the opening to determine whether the user is authorized to discharge the electronic firearm; and wherein said opening is substantially bisected by a centerline of said rear side of said grip portion and includes a lens which is flush with an exterior surface of said grip portion.

2. An electronic firearm as defined in claim 1, wherein the at least one opening defined by the rear side of the grip portion is at a location along the grip portion to oppose an area of the user's hand that applies generally uniform contact pressure.

3. An electronic firearm as defined in claim 1, wherein the at least one opening defined by the rear side of the grip portion is disposed generally at an upper location along the grip portion to oppose the web area of the user's hand.

4. An electronic firearm as defined in claim 1, wherein the at least one opening defined by the rear side of the grip portion is disposed generally at a lower location along the grip portion to oppose the palm of the user's hand.

5. An electronic firearm as defined in claim 1, wherein the biometric sensing device includes means for determining the pore structure of the skin of the user's hand.

6. An electronic firearm comprising:

a barrel assembly; and a handle assembly coupled to the barrel assembly, the handle assembly including a grip portion defining a cavity and at least one opening disposed generally at a rear side of the grip portion at a lower location along the grip portion to oppose the palm of the user's hand, and a biometric sensing device disposed within the cavity and aligned with the at least one opening of the grip portion for scanning the palm of the user's hand opposing the opening to determine whether the user is authorized to discharge the electronic firearm; and wherein said opening is substantially bisected by a centerline of said rear side of said grip portion and includes a lens which is flush with an exterior surface of said grip portion.

7. An electronic firearm as defined in claim 6, wherein the biometric sensing device includes means for determining the pore structure of the palm of the user's hand.

8. An electronic firearm comprising:

a barrel assembly; and a handle assembly coupled to the barrel assembly, the handle assembly including a grip portion defining a cavity and at least one opening disposed generally at a rear side of the grip portion at an upper location along the grip portion to oppose the web area of the user's hand, and a biometric sensing device disposed within the cavity and aligned with the at least one opening of the grip portion for scanning the web area of the user's hand opposing the opening to determine whether the user is authorized to discharge the electronic firearm; and wherein said opening defines a recess in said grip portion and is substantially bisected by a centerline of said rear side of said grip portion.

9. An electronic firearm as defined in claim 8, wherein the biometric sensing device includes means for determining the pore structure of the web area of the user's hand.

* * * * *